US012055134B2

(12) United States Patent
Frank et al.

(10) Patent No.: US 12,055,134 B2
(45) Date of Patent: Aug. 6, 2024

(54) RECIPROCATING-PISTON MACHINE, COMPRESSED AIR SUPPLY SYSTEM, VEHICLE AND METHOD FOR PRODUCING A RECIPROCATING-PISTON MACHINE

(71) Applicant: ZF CV Systems Hannover GmbH, Hannover (DE)

(72) Inventors: Dieter Frank, Hannover (DE); Eduard Nuss, Gronau (DE)

(73) Assignee: ZF CV SYSTEMS EUROPE BV, Brussels (BE)

( * ) Notice: Subject to any disclaimer, the term of this patent is extended or adjusted under 35 U.S.C. 154(b) by 552 days.

(21) Appl. No.: 17/290,273

(22) PCT Filed: Oct. 22, 2019

(86) PCT No.: PCT/EP2019/078737
§ 371 (c)(1),
(2) Date: Apr. 30, 2021

(87) PCT Pub. No.: WO2020/099073
PCT Pub. Date: May 22, 2020

(65) Prior Publication Data

US 2021/0404458 A1 Dec. 30, 2021

(30) Foreign Application Priority Data

Nov. 14, 2018 (DE) ..... 10 2018 128 557.4

(51) Int. Cl.
*F04B 39/00* (2006.01)
*F04B 9/04* (2006.01)
(Continued)

(52) U.S. Cl.
CPC ..... *F04B 39/0022* (2013.01); *F04B 9/04* (2013.01); *F04B 9/045* (2013.01); *F04B 25/005* (2013.01);
(Continued)

(58) Field of Classification Search
CPC ..... F04B 27/02; F04B 9/045; F04B 27/005; F04B 35/01; F04B 39/0022; F04B 25/005;
(Continued)

(56) References Cited

U.S. PATENT DOCUMENTS 10,641,257 B2 5/2020 Bredbeck et al.
10,704,542 B2 * 7/2020 Bredbeck ..... F04B 39/0027
(Continued)

FOREIGN PATENT DOCUMENTS

DE 4420861 A1 12/1994
DE 102016001596 A1 8/2017
(Continued)

*Primary Examiner* — Peter J Bertheaud
(74) *Attorney, Agent, or Firm* — LEYDIG, VOIT & MAYER, LTD.

(57) ABSTRACT

A reciprocating-piston machine, in particular a two-stage or multi-stage piston compressor, includes: a first connecting rod for deflecting a first piston and which has a connecting-rod eye, the first connecting rod being a drive connecting rod; a second connecting rod for deflecting a second piston and which has at least one further connecting-rod eye, the second connecting rod being a follower connecting rod; a coupling element which extends through the connecting-rod eye and the at least one further connecting-rod eye and about which the first connecting rod and the second connecting rod are rotationally movable relative to one another; a coupling bearing element arranged between the coupling element and a connecting-rod eye inner surface of the connecting-rod eye; and a damping element with elastic damping action arranged in a damping annular chamber between the coupling bearing element and the connecting-rod eye inner surface of the connecting-rod eye.

32 Claims, 5 Drawing Sheets

(51) Int. Cl.

| | |
|---|---|
| ***F04B 25/00*** | (2006.01) |
| ***F04B 27/00*** | (2006.01) |
| ***F04B 27/02*** | (2006.01) |
| ***F04B 35/01*** | (2006.01) |
| ***F04B 53/00*** | (2006.01) |
| ***F04B 53/14*** | (2006.01) |

(52) U.S. Cl.
CPC ..... *F04B 27/005* (2013.01); *F04B 27/02* (2013.01); *F04B 35/01* (2013.01); *F04B 39/0005* (2013.01); *F04B 39/0027* (2013.01); *F04B 39/0044* (2013.01); *F04B 53/001* (2013.01); *F04B 53/144* (2013.01); *F04B 53/145* (2013.01); *F04B 53/147* (2013.01)

(58) Field of Classification Search
CPC ..... F04B 39/0005; F04B 53/144; F04B 39/0027; F04B 39/0044; F04B 9/04; F04B 53/001; F04B 53/145; F04B 53/147
See application file for complete search history.

(56) References Cited

U.S. PATENT DOCUMENTS

| | | | |
|---|---|---|---|
| 2004/0231508 | A1 | 11/2004 | Mueller |
| 2005/0238513 | A1 | 10/2005 | Mueller |
| 2014/0119961 | A1 | 5/2014 | Gonzalez et al. |

FOREIGN PATENT DOCUMENTS

| | | | | |
|---|---|---|---|---|
| EP | 1589224 | A1 | 10/2005 | |
| EP | 1479909 | B1 | 6/2006 | |
| EP | 2646302 | B1 | 5/2016 | |
| WO | WO 2017/137141 | A1 | 8/2017 | |
| WO | WO-2017137141 | A1 * | 8/2017 | ..... B60G 11/27 |

* cited by examiner

RECIPROCATING-PISTON MACHINE, COMPRESSED AIR SUPPLY SYSTEM, VEHICLE AND METHOD FOR PRODUCING A RECIPROCATING-PISTON MACHINE

CROSS-REFERENCE TO PRIOR APPLICATIONS

This application is a U.S. National Phase application under 35 U.S.C. § 371 of International Application No. PCT/EP2019/078737, filed on Oct. 22, 2019, and claims benefit to German Patent Application No. DE 10 2018 128 557.4, filed on Nov. 14, 2018. The International Application was published in German on May 22, 2020 as WO 2020/099073 A1 under PCT Article 21(2).

FIELD

The invention relates to a reciprocating-piston machine, in particular a two-stage or multi-stage piston compressor. The invention furthermore relates to a compressed-air supply installation, a compressed-air supply system and a vehicle, in particular a passenger motor vehicle, having a reciprocating-piston machine, in particular having a piston compressor, and to a method for producing a reciprocating-piston machine.

BACKGROUND

A compressed-air supply installation is used in vehicles of all types, in particular for the supply of compressed air to an air spring installation of a passenger motor vehicle or of a utility vehicle. Air spring installations may also comprise ride-height control devices by means of which the distance between a vehicle axle and vehicle body can be set. An air spring installation of a pneumatic compressed-air supply system mentioned in the introduction comprises a number of air bellows which are pneumatically connected to a common line (gallery) and which, with increasing filling, can raise the vehicle body and, with decreasing filling, can lower the vehicle body. Such a system is used for example in an off-road vehicle and a sport utility vehicle (SUV) or a goods or passenger transport vehicle.

To ensure long-term operation of the compressed-air supply installation, the latter has an air dryer which is provided for drying the compressed air. This avoids the accumulation of moisture in the compressed-air supply system, which can otherwise, in the presence of relatively low temperatures, lead to valve-damaging ice crystal formation and other undesired effects in the compressed-air supply installation and in the pneumatic installation. An air dryer has a drying agent, commonly a granulate fill, through which the compressed air can flow such that the granulate fill can—in the presence of relatively high pressure—adsorb moisture contained in the compressed air. Here, it has often been proven to be expedient to accommodate the drying granulate in a dryer cartridge which has a dryer bed for conducting a compressed-air flow.

A compressed-air supply installation for use in a pneumatic compressed-air supply system with a pneumatic installation, for example with an above-described air spring installation, is operated with compressed air from a compressed-air feed, for example in the range of a pressure level from 5 bar to 20 bar. The compressed air is provided to the compressed-air feed by means of an air compressor (compressor), in the present case with a reciprocating-piston machine, preferably with a two-stage or multi-stage piston compressor.

In a compressed-air supply installation for a compressed-air supply system in a vehicle, the compressed-air feed to which a supply is provided by the air compressor is on the one hand, for the supply to the pneumatic installation, pneumatically connected to a compressed-air connection and is on the other hand pneumatically connected to a ventilation connection. By means of a ventilation valve arrangement, the compressed-air supply installation and/or the pneumatic installation can be ventilated by release of air to the ventilation connection.

The reciprocating-piston machine in the air compressor (compressor) of the compressed-air feed is generally driven by means of a drive motor, the drive power of which is transmitted via a crankshaft and multiple connecting rods to multiple pistons. The drive of the reciprocating-piston machine in the air compressor (compressor) of the compressed-air feed may also be realized for example by means of a belt drive.

In this way, ambient air which is drawn in, or intake air fed from some other compressed-air source, is compressed. For this purpose, so-called twin piston compressors have basically proven expedient; that is to say two-stage piston compressors, the two pistons of which are driven by means of two connecting rods respectively assigned thereto, which connecting rods in turn are oriented exactly along a cylinder axis, which preferably runs so as to be oriented exactly parallel and center-symmetrically in relation to cylinder barrels in the cylinder swept volume for the piston.

Depending on the required dynamics and pressure loading, a two-stage or multi-stage compressor of said type or of some other type can, during operation, generate increasing operating noise which—as has been found—can be caused significantly by structure-borne sound transmission through the connecting-rod drive inter alia into the drive motor of the compressor or the housing thereof. It is desirable to realize improved acoustics and a nevertheless reliable connecting-rod drive in a compressor in the form of the stated reciprocating-piston machine. It is in particular also the intention for this to be sufficient for a particularly low noise level in the passenger motor vehicle sector.

WO 2017/137141 A1 discloses a reciprocating-piston machine.

The reciprocating-piston machine known from WO 2017/137141 A1 still has potential for improvement.

SUMMARY

In an embodiment, the present invention provides a reciprocating-piston machine, in particular a two-stage or multi-stage piston compressor, comprising: a first connecting rod configured to deflect a first piston and which has a connecting-rod eye, the first connecting rod comprising a drive connecting rod; a second connecting rod configured to deflect a second piston and which has at least one further connecting-rod eye, the second connecting rod comprising a follower connecting rod; a coupling element which extends through the connecting-rod eye and the at least one further connecting-rod eye and about which the first connecting rod and the second connecting rod are rotationally movable relative to one another; a coupling bearing element arranged between the coupling element and a connecting-rod eye inner surface of the connecting-rod eye; and a damping element with elastic damping action arranged in a damping annular chamber between the coupling bearing element and the connecting-rod eye inner surface of the connecting-rod eye, wherein the damping element fills the damping annular chamber such that a ball jointed configuration which generates a form fit arises between the coupling bearing element and the connecting-rod eye inner surface of the connecting-rod eye.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
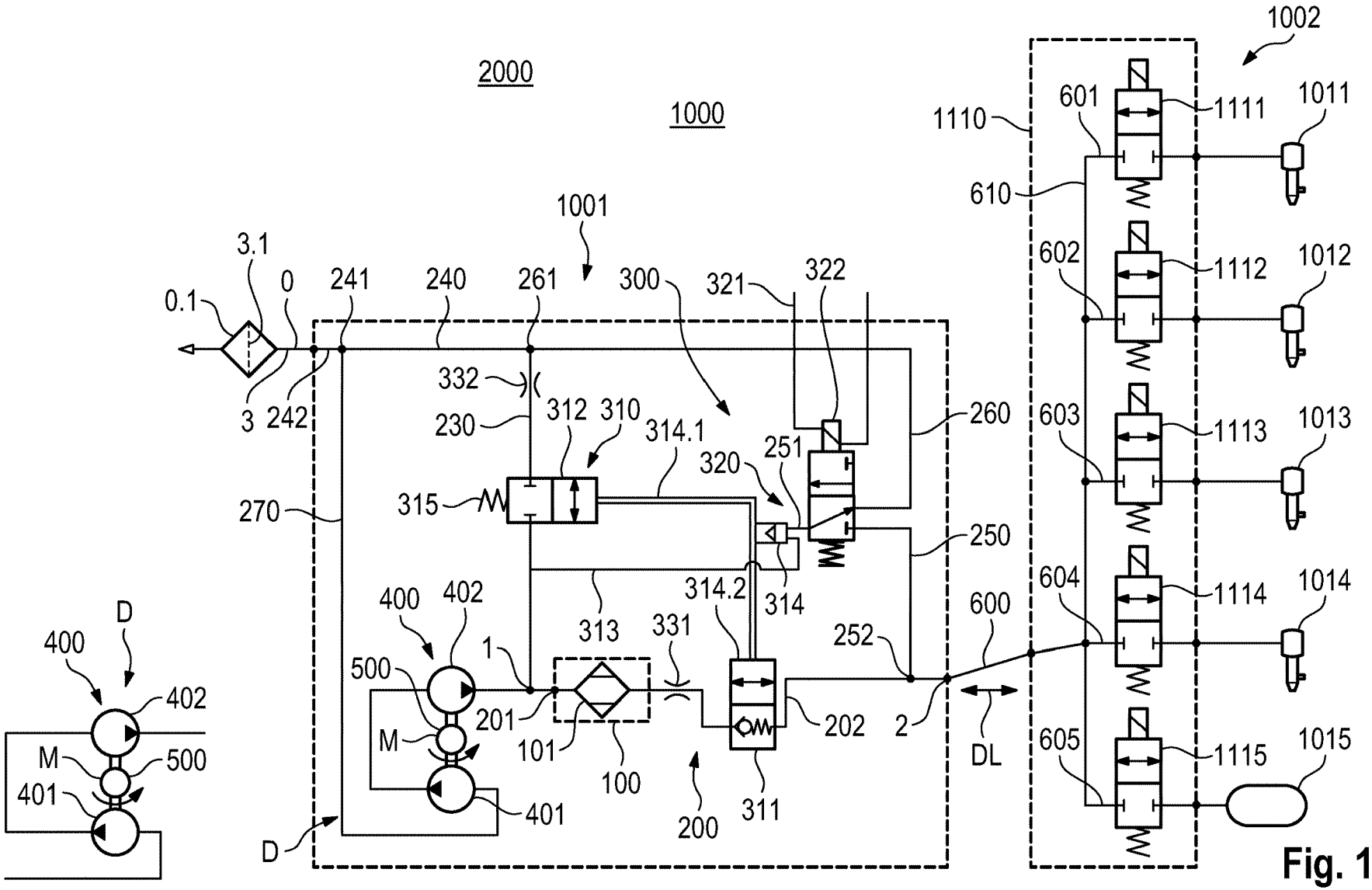
FIG. 1: shows a pneumatic circuit for an embodiment of a compressed-air supply installation with connected pneumatic installation in the form of an air spring installation for a vehicle, wherein a piston compressor shown in the detail D, in the context of an air compressor, supplies compressed air to the air spring installation via an air dryer arrangement and a valve arrangement designed as an unblockable check valve, which is switchable by means of a controllable solenoid valve.

In an embodiment, the present invention provides a reciprocating-piston machine, in particular a two-stage or multi-stage piston compressor, preferably twin compressor, and a compressed-air supply installation for operating a pneumatic installation with a compressed-air flow, by means of which even further improved acoustics and a nevertheless reliable connecting-rod drive in a piston compressor can be realized. It is in particular also the intention for this to be suitable for noise level requirements in the passenger motor vehicle sector. In particular, it is the intention that, in the context of an acoustic improvement, structure-borne sound emissions of a connecting-rod drive into adjacent, radiating components, such as electric motor, crank drive or similar components of an air compressor (compressor), are further reduced. Furthermore, it is the intention that the reciprocating-piston machine can be produced inexpensively. It is also an object of the invention to specify a corresponding compressed-air supply system and a vehicle having the compressed-air supply system, in particular for an air spring installation. It is also the intention to provide an inexpensive method for producing the reciprocating-piston machine.

In an embodiment, the present invention provides a reciprocating-piston machine, in particular a two-stage or multi-stage piston compressor, as described herein.

This has:

- a first connecting rod which is designed for the deflection of a first piston and which has a connecting-rod eye, wherein, in particular, the first connecting rod is a drive connecting rod,
- a second connecting rod which is designed for the deflection of a second piston and which has at least one further connecting-rod eye, wherein, in particular, the second connecting rod is a follower connecting rod, and
- a coupling element which extends through the connecting-rod eye and the at least one further connecting-rod eye and about which the first connecting rod and the second connecting rod are rotationally movable relative to one another,
- wherein a coupling bearing element is arranged between the coupling element and a connecting-rod eye inner surface of the connecting-rod eye, and
- wherein a damping element with elastic damping action is arranged in a damping annular chamber between the coupling bearing element and the connecting-rod eye inner surface of the connecting-rod eye.

It is provided according to the invention that the damping element fills the damping annular chamber such that a ball jointed configuration which generates a form fit arises between the coupling bearing element and the connecting-rod eye inner surface of the connecting-rod eye.

The reciprocating-piston machine makes it possible, in the event of tilting of the connecting rods relative to one another during operation, to reduce lateral distortion and improve the acoustics.

The damping element may for example be an elastically damping elastomer element or the like. It is also possible for multiple damping elements to be arranged in the damping annular chamber. The coupling element may for example be a bearing journal or the like. The coupling bearing element may have a connecting-rod bearing. The connecting-rod bearing may have a plain bearing or a rolling bearing, in particular a needle-roller bearing, a ball bearing or a barrel-roller bearing. The first piston may be part of the first connecting rod or connected to the first connecting rod. The second piston may be part of the second connecting rod or connected to the second connecting rod. The pistons may for example each be held by means of a piston holder, fixedly connected to the respective connecting rod, or formed integrally on the respective connecting rod.

The second connecting-rod eye may have a further connecting-rod eye, two further connecting-rod eyes, three further connecting-rod eyes or more further connecting-rod eyes. The further connecting-rod eyes may be oriented along a coupling element axis of the coupling element, which coupling element axis extends through the connecting-rod eye and the at least one further connecting-rod eye and along the coupling element. The first connecting rod and the second connecting rod are rotationally movable relative to one another about the coupling element axis.

It is also possible for further coupling bearing elements and damping elements to be arranged between the coupling element and further connecting-rod eye inner surfaces of the further connecting-rod eyes. In this case, the damping elements are preferably arranged in a respective further damping annular chamber between the respective further coupling bearing element and the respective further connecting-rod eye inner surface of the further connecting-rod eyes and fill the respective further damping annular chamber such that a ball-jointed configuration which generates a form fit arises between the coupling element and the connecting rods.

The object relating to the compressed-air supply installation is achieved by means of a compressed-air supply installation as described herein. A compressed-air supply installation for the operation of a pneumatic installation, in particular of an air spring installation of a vehicle, preferably of a passenger motor vehicle, with a compressed-air flow has:

- an air dryer arrangement in a pneumatic main line which pneumatically connects a compressed-air feed from an air compressor and a compressed-air connection to the pneumatic installation, and
- a valve arrangement, which is pneumatically connected to the pneumatic main line and which serves for controlling the compressed-air flow, and an air dryer in the pneumatic main line, wherein
- an air compressor having a reciprocating-piston machine, in particular a two-stage or multi-stage piston compressor, preferably twin compressor, as described herein, is connected to the compressed-air feed.

The object relating to the compressed-air supply system is achieved by means of a compressed-air supply system as described herein. The invention also specifies a vehicle, in particular a passenger motor vehicle, as described herein. Alternatively, it is also possible for a heavy goods vehicle to be provided; in particular, a heavy goods vehicle compressor for air treatment may be provided.

A compressed-air supply system having a pneumatic installation and having a compressed-air supply installation as described herein serves for the operation of the pneumatic installation with a compressed-air flow, in particular of an air spring installation of a vehicle, preferably of a passenger motor vehicle, wherein the pneumatic main line pneumatically connects a compressed-air feed from an air compressor having a reciprocating-piston machine, in particular a two-stage or multi-stage piston compressor, preferably twin compressor, as described herein and a compressed-air connection to the pneumatic installation.

A vehicle, in particular passenger motor vehicle, is equipped with a pneumatic installation, in particular an air spring installation, and a compressed-air supply installation as described herein for the operation of the pneumatic installation with a compressed-air flow.

The invention also specifies a method as described herein for producing a reciprocating-piston machine, in particular a two-stage or multi-stage piston compressor.

The reciprocating-piston machine to be produced has:

- a first connecting rod which is designed for the deflection of a first piston and which has a connecting-rod eye, wherein, in particular, the first connecting rod is a drive connecting rod,
- a second connecting rod which is designed for the deflection of a second piston and which has at least one further connecting-rod eye, wherein, in particular, the second connecting rod is a follower connecting rod, and
- a coupling element which, in the assembled state, extends through the connecting-rod eye and the at least one further connecting-rod eye and about which the first connecting rod and the second connecting rod are rotationally movable relative to one another.

To produce the reciprocating-piston machine, it is provided that

- a coupling bearing element is arranged between the coupling element and a connecting-rod eye inner surface of the connecting-rod eye, and
- a damping element with elastic damping action is arranged in a damping annular chamber between the coupling bearing element and the connecting-rod eye inner surface of the connecting-rod eye.

According to the invention, to produce the reciprocating-piston machine, it is provided that

- the damping annular chamber is filled with the damping element such that a ball-jointed configuration which generates a form fit is generated between the coupling bearing element and the connecting-rod eye inner surface of the connecting-rod eye.

The invention proceeds from the consideration that, depending on the required dynamics and pressure loading in an air compressor, a two-stage or multi-stage compressor, in particular a two-stage twin compressor or some other reciprocating-piston machine, during operation, increasingly generates operating noise which—as has been found—can be caused in particular by structure-borne sound transmission through the connecting-rod drive into the compressor drive motor. In the case of customary plain bearings and needle-roller bearings, a high level of noise is generated, in particular in the event of load alteration between the connecting rods. It has been found, as recognized by the invention, that the operating noise is caused in part by connecting-rod bearing play that is structurally required in the prior art. The connecting-rod bearing play between a needle-roller bearing inner diameter of a needle-roller bearing and a coupling element, in particular bearing journal, has a major influence on the acoustics characteristics. In order to counteract the variance of play arising from manufacturing and parts tolerances, it is the case in the manufacturing process that, prior to assembly, a respective present bearing inner diameter is measured and, depending on the measured value, a corresponding bearing journal with corresponding diameter is selected and installed. Owing to tolerances that continue to exist in a motor axial direction, lateral distortion of the connecting rods relative to one another can occur, which has an adverse effect on the acoustics characteristics. There is also the risk of the connecting rods abutting against one another. It is sought to compensate for the connecting-rod bearing play for example of needle-roller bearings for example by means of metallically hard stops, which however lead to high levels of acoustic emissions. A plain bearing composed in particular of plastic can, owing to its relatively soft material characteristics, compensate for the hard stops of the connecting-rod bearing play. However, plain bearings become worn over time, such that, over relatively long periods of use of the plain bearings, a relatively large increase in connecting-rod bearing play occurs, which in turn leads to an increase in noise. Plastics plain bearings in particular have good damping characteristics but are sensitive to wear at high temperatures and exhibit intense run-in characteristics, which leads to an increase in connecting-rod bearing play. This leads to an increase in the acoustic emissions over the duration of the service life of the plastics plain bearings. By contrast, rolling bearings basically exhibit poor damping characteristics because, in this case, there is typically steel-on-steel contact.

A reciprocating-piston machine in which a damping element is used for damping a coupling bearing element makes it possible to realize improved acoustics in a compressor; however, in the case of strict guidance, lateral distortion between the connecting rods can occur, which can have an adverse effect on the acoustics characteristics. In the case of insufficiently strict guidance, a spring-deflection movement can be too great. Also, it is not possible to realize small dead spaces.

The invention has now recognized that, through skillful filling of the damping annular chamber with the damping element, a ball jointed configuration which generates a form fit can be achieved, by means of which improved acoustics and a nevertheless reliable connecting-rod drive in a compressor can be realized; even with a low level of noise generation which is in particular acceptable for the passenger motor vehicle sector. Furthermore, the concept of the present invention is likewise preferred for a utility vehicle or passenger transport vehicle, in particular if, in this, the compressed-air supply installation is configured for relatively high pressure amplitudes. The invention may likewise be used in the heavy goods vehicle sector.

The damping characteristics of the damping element can reduce the stimulation of structure-borne sound. A transmission of energy between the connecting rod, the coupling element and the coupling bearing element by means of the damping element can be reduced, in order to reduce the transmission of noise. The damping element makes it possible, owing to the ball jointed configuration which generates the form fit, for the connecting rods to rotate more freely relative to one another. Furthermore, a substantially tolerance-free changeover is possible upon the reversal of movement of the connecting rods. The piston length and thus a dead space can also be set by way of the filling of the damping annular chamber. Furthermore, a load on the edges of the coupling bearing element can be reduced, because tilting and warping of the connecting rods can be better compensated for by way of the damping element and in particular the ball jointed configuration which generates the form fit. This in turn reduces the wear. A correction of oblique positioning and/or shaft bending is also possible by means of the damping element. The use of the damping element for the damping of the coupling bearing element furthermore makes it possible for temperature-induced variations of the components, in particular of the connecting rods and of the coupling element, to be compensated, whereby smaller bearing tolerances are made possible in particular in high-temperature and low-temperature applications. In particular, a material expansion in a radial direction in the event of temperature changes can be compensated for. Furthermore, the bearing loading can be reduced by virtue of the fact that the structure-borne sound emissions of the stimulated axes and the stiffness between the connecting rods or connecting-rod assemblies can be reduced.

The invention allows in particular an optimization of the acoustic characteristics, in particular of a two-stage twin compressor, because the damping element can be parameterized substantially freely with regard to its design criteria. For example, the selection of the material, that is to say the hardness, and the geometry of the damping element, that is to say the diameter, the width, the wall thickness and/or similar parameters can be parameterized substantially freely, specifically under the constraint that a ball jointed configuration which generates a form fit is attained. This can lead inter alia to a reduction of the generation of noise, in particular of the initial level, of the level variance and of the level increase over the operating duration. The possibility of substantially free parameterization makes it possible for the damping element to be adapted in each case to the present operating conditions.

In one advantageous refinement, the reciprocating-piston machine according to the invention is characterized in that the ball jointed configuration, which generates the form fit, between the coupling bearing element and the connecting-rod eye inner surface is generated by virtue of at least one of the damping element surfaces, which lie against the coupling bearing element and the connecting-rod eye inner surface, of the damping element being impressed. As a result of the impressing, the damping element can assume various shapes which allow a ball jointed configuration, which generates a form fit, between the coupling bearing element and the connecting-rod eye inner surface. It is particularly preferable for at least one of the damping element surfaces which lie against the coupling bearing element and the connecting-rod eye inner surface to be impressed by the coupling bearing element and/or the connecting-rod eye inner surface. The coupling bearing element and the connecting-rod eye inner surface may be shaped so as to impress the damping element. The damping element surface that lies against the coupling bearing element may be impressed by the coupling bearing element, and the damping element surface which lies against the connecting-rod eye inner surface may be impressed by the connecting-rod eye inner surface. As a result of the damping element being impressed by the coupling bearing element and/or the connecting-rod eye inner surface, a form fit can be generated, along with a ball-jointed configuration.

In the context of a preferred refinement of the reciprocating-piston machine, the damping element fills the damping annular chamber such that holding forces generated as a result of the form fit are greater than shear forces which act on the damping element during the operation of the reciprocating-piston machine. The form fit generated as a result of the filling of the damping annular chamber with the damping element makes it possible to produce a firm connection without fastening the damping element to the coupling bearing element and/or to the connecting-rod eye inner surface.

The coupling bearing element preferably has a bearing bushing. The bearing bushing has a bearing bushing outer surface situated opposite the connecting-rod eye inner surface. The damping element may be arranged in the damping annular chamber between the connecting-rod eye inner surface and the bearing bushing outer surface. The bearing bushing may for example be a plain bearing bushing, in particular a metal bushing or the like. The bearing bushing makes a stable bearing arrangement possible.

In the context of a preferred refinement of the reciprocating-piston machine, the connecting-rod eye inner surface and the bearing bushing outer surface each have at least one arcuate surface section which is domed in the direction of the opposite surface and which encircles the respective one of the opposite surfaces; in other words, the connecting-rod eye inner surface and the bearing bushing outer surface are convexly curved in the direction of one another. It is particularly preferable if the damping element surfaces, which lie against the coupling bearing element and the connecting-rod eye inner surface, of the damping element are impressed by the connecting-rod eye inner surface and the bearing bushing outer surface such that the damping element has a biconcave shape along the damping annular chamber. The connecting-rod eye inner surface and the bearing bushing outer surface are in this case outwardly domed toward one another. This design makes it possible to produce a ball jointed configuration which generates a form fit. The domed formation may have various shapes, which may for example be optimized in order to optimize a rolling characteristic. Instead of a single domed formation, the connecting-rod eye inner surface and the bearing bushing outer surface may also have multiple domed formations shaped so as to improve the rolling characteristics. This makes it possible to improve the rolling behavior.

In one advantageous refinement, the connecting-rod eye has a web which runs centrally along the connecting-rod eye inner surface and which extends in the direction of the bearing bushing outer surface. This design makes it possible to produce a ball jointed configuration which generates a form fit. Alternatively or in addition, the bearing bushing may have a web which runs centrally along the bearing bushing outer surface and which extends in the direction of the connecting-rod eye inner surface.

It is particularly preferable if the bearing bushing has an outer diameter smaller than a smallest inner diameter, generated by the web, of the connecting-rod eye. A holding force generated by the form fit can be set by way of the difference between the outer diameter of the bearing bushing and the smallest inner diameter of the connecting-rod eye. A small difference between outer diameter of the bearing bushing and smallest inner diameter of the connecting-rod eye makes it possible to generate a form fit in the case of which very high shear forces are required in the damping element in order to release the connection of bearing bushing, damping element and connecting-rod eye inner surface. The holding forces that are generated make it possible to dispense with vulcanizing the damping element onto the bearing bushing and the connecting-rod eye inner surface. The outer diameter of the bearing bushing may for example be between 0.1% and 10% smaller than the smallest inner diameter of the connecting-rod eye.

In one advantageous refinement, the bearing bushing has a groove which runs centrally along the bearing bushing outer surface and which extends away from the connecting-rod eye inner surface. The groove may have a greater width and a greater height than the web. The groove makes it possible to generate a higher holding force and enhance the jointed configuration. Alternatively or in addition, the connecting-rod eye may have a groove which runs centrally along the connecting-rod eye inner surface and which extends away from the bearing bushing outer surface.

The bearing bushing is preferably coated with a material with a low coefficient of friction. The bearing bushing may for example be coated with polytetrafluoroethylene (PTFE) or the like. A coating with a material with low coefficient of friction, such as for example PTFE, improves the plain bearing characteristics. The coated bearing bushing may be coated on its end surfaces. This makes it possible to use the coated bearing bushing as a stop disk in the presence of severe offsets. The bearing bushing may be completely coated in a drum process. This allows inexpensive production.

The damping element is particularly preferably injection-molded into the damping annular chamber and completely vulcanized. The injection-molding may be performed under the action of pressure and heat. By means of the injection-molding of the damping element, the coupling bearing element can be arranged and aligned in the connecting-rod eye in advance. This makes it possible for the coupling bearing element to be accurately positioned, and thus for lengths and position dimensions of the pistons to be set. By means of the setting of the piston length, it is possible to set a dead space. In this case, the damping element does not need to be vulcanized onto the connecting-rod eye inner surface and/or does not need to be vulcanized onto the bearing bushing outer surface.

In one advantageous refinement, the damping element is not vulcanized onto the connecting-rod eye inner surface and/or is not vulcanized onto the bearing bushing outer surface. The damping element may be both not vulcanized onto the connecting-rod eye inner surface and not vulcanized onto the bearing bushing outer surface, or may only be not vulcanized onto one of the two surfaces. This makes it possible to reduce or omit an adhesion promoter. Furthermore, the reciprocating-piston machine can be produced in fewer production steps. This allows a reduction in costs for the production of the reciprocating-piston machine.

It is particularly preferable if the damping element, the connecting-rod eye inner surface and the coupling bearing element are shaped so as to collectively form a ball-joint-like bearing. This makes it possible, through coordination of the shapes of the damping element, of the connecting-rod eye inner surface and of the coupling bearing element with one another, to generate a ball jointed configuration which generates a form fit.

In one advantageous refinement, the connecting-rod eye of the first connecting rod is arranged between two of the further connecting-rod eyes of the second connecting rod, and the coupling element extends through the three connecting-rod eyes. The second connecting rod may partially surround the first connecting rod. The second connecting rod may for example be in the form of a fork with two prongs, and the first connecting rod may be in the form of a bar which is arranged between the two prongs of the fork. In this case, in each case one of the two further connecting-rod eyes is arranged in one of the prongs and the further connecting-rod eyes are arranged opposite one another along the coupling element axis.

The reciprocating-piston machine particularly preferably has a first cylinder and a second cylinder. The first piston is preferably assigned to the first cylinder, and the second piston is preferably assigned to the second cylinder. Preferably, during operation, the pistons are deflected along a radially oriented cylinder axis in a respective cylinder swept volume of the respective cylinder. The reciprocating-piston machine particularly preferably has a crankshaft which can be driven during operation and which has a crankshaft journal which is arranged along a shaft axis of the crankshaft, which shaft axis runs eccentrically with respect to an axially oriented motor axis and runs perpendicular to the radially oriented cylinder axis. Preferably, the reciprocating-piston machine has a drive shaft coupling which is oriented along the axially oriented motor axis and which is designed for the coupling of a drive shaft for driving the crankshaft. The first connecting rod preferably runs along a first connecting-rod axis running parallel to the radially oriented cylinder axis, and the second connecting rod preferably runs along a second connecting-rod axis running parallel to the radially oriented cylinder axis. The reciprocating-piston machine makes it possible, in the event of tilting of the connecting rods along the motor axis during operation, to reduce distortion of the connecting rods that occurs in a direction parallel to the motor axis.

The cylinder axis is oriented substantially symmetrically with respect to cylinder barrels for the pistons in the cylinder swept volumes of the at least one cylinder. A cylinder axis with cylinder swept volumes oriented therewith is to be understood in particular to mean that the cylinder barrels at the cylinder swept volumes of a cylinder for the piston are exactly parallel and symmetrical with respect to the cylinder axis.

In one advantageous refinement, the damping element radially completely fills the damping annular chamber between the coupling bearing element and the connecting-rod eye inner surface. The damping element may also completely fill the damping annular chamber in an axial direction, that is to say in a direction running parallel to the motor axis.

In the context of one preferred refinement, the first connecting rod, in particular as a drive connecting rod, is mounted by means of a crankshaft bearing element directly on the crankshaft journal and is movable by means of the crankshaft journal, and the second connecting rod, in particular as a follower connecting rod, is movable by means of the coupling element. A direct mounting is to be understood to mean that the connecting rod is moved directly by the crankshaft journal via the crankshaft bearing element. The second connecting rod may be mounted indirectly on the crankshaft journal by means of the coupling bearing element and the coupling element. It is particularly preferable if the first connecting rod is movable directly by means of the crankshaft journal and the second connecting rod is movable indirectly by means of the crankshaft journal, in particular by means of the first connecting rod. In particular, at least the second connecting rod, as a follower connecting rod, may be movable by the first connecting rod, as drive connecting rod.

In one advantageous refinement, the connecting rods are designed such that a maximum deflection angle of the deflection of the connecting rods between the first connecting-rod axis and the second connecting-rod axis in the direction of a deflection axis running perpendicular to the cylinder axis and perpendicular to the motor axis amounts to at most 14°. The maximum deflection angle may for example be at most 10°, at most 8°, preferably 7°. The connecting rods may be designed such that, if a deflection angle greater than the maximum deflection angle occurs, the damping element dampens the deflection such that the connecting rods are prevented from abutting against one another.

In the context of one advantageous refinement of the reciprocating-piston machine, the first piston is held on the first connecting rod by means of a piston holder, the second connecting rod is connected to the first connecting rod by means of the coupling bearing element and the coupling element, and the second piston is formed integrally on the second connecting rod.

In one advantageous refinement, the reciprocating-piston machine is formed as a two-stage compressor with a first and a second compressor stage, in particular as a twin compressor. It is particularly preferable if the first connecting rod of the second, in particular (high-pressure) compressor stage is formed, and/or the second connecting rod of the first, in particular (low-pressure) compressor stage is formed, and the second connecting rod is mounted by means of the coupling bearing element and the coupling element directly on the first connecting rod.

In the context of one advantageous refinement of the reciprocating-piston machine, the damping element has no sliding surfaces.

In the context of one preferred refinement of the method for producing the reciprocating-piston machine, the damping annular chamber is filled with the damping element such that at least one of the damping element surfaces, which lie against the coupling bearing element and the connecting-rod eye inner surface, of the damping element is impressed.

The damping annular space is particularly preferably filled with the damping element such that the at least one of the damping element surfaces which lie against the coupling bearing element and the connecting-rod eye inner surface is impressed by the coupling bearing element and/or the connecting-rod eye inner surface.

In one preferred refinement of the method for producing the reciprocating-piston machine, a web is injection-molded on centrally along the connecting-rod eye inner surface, which web extends in the direction of the coupling element. The web serves for impressing the damping element, such that a ball jointed configuration which generates a form fit can be generated. Alternatively or in addition, a bearing bushing may be provided as part of the coupling bearing element, and the bearing bushing may be equipped with a web which runs centrally along the bearing bushing outer surface and which extends in the direction of the connecting-rod eye inner surface; in particular, the web may be injection-molded on.

It is particularly preferable if a bearing bushing is provided as part of the coupling bearing element and the bearing bushing is arranged in the connecting-rod eye, parallel to an axially oriented motor axis, such that a bearing bushing outer surface of the bearing bushing is situated opposite the connecting-rod eye inner surface. The arrangement of the bearing bushing in the connecting-rod eye makes it possible to set lengths and position dimensions of the pistons. This makes it possible to set a dead space.

The bearing bushing is preferably selected such that the bearing bushing has an outer diameter smaller than a smallest inner diameter, generated by the web, of the connecting-rod eye.

In one advantageous refinement of the method for producing the reciprocating-piston machine, the bearing bushing, before being arranged in the connecting-rod eye, is provided with a groove which runs centrally along the bearing bushing outer surface and which extends away from the connecting-rod eye inner surface. The groove particularly preferably has a greater width and a greater height than the web. Alternatively or in addition, a groove which runs centrally along the connecting-rod eye inner surface may be provided, in particular milled in, which groove extends away from the bearing bushing outer surface.

In the context of one advantageous refinement of the method for producing the reciprocating-piston machine, the coupling bearing element has a bearing bushing which is arranged in the connecting-rod eye, parallel to an axially oriented motor axis, such that a bearing bushing outer surface of the bearing bushing is situated opposite the connecting-rod eye inner surface. Preferably, the connecting-rod eye inner surface and the bearing bushing outer surface are shaped so as to each have at least one arcuate surface section which is domed in the direction of the opposite surface and which encircles the respective one of the opposite surfaces; in other words, the connecting-rod eye inner surface and the bearing bushing outer surface are convexly curved in the direction of one another.

It is particularly preferable if the damping element is arranged with a shape, which is biconcave parallel to the axially oriented motor axis and which nestles against the connecting-rod eye inner surface and the bearing bushing outer surface, along the damping annular chamber between the connecting-rod eye inner surface and the bearing bushing outer surface.

In one advantageous refinement of the method for producing the reciprocating-piston machine, the damping element is injection-molded into the damping annular chamber and is completely vulcanized.

It is particularly preferable if, during the complete vulcanization, the damping element is not vulcanized onto the connecting-rod eye inner surface and/or is not vulcanized onto the coupling bearing element.

In one advantageous refinement, the bearing bushing, before being arranged in the connecting-rod eye, is coated with a material with a low coefficient of friction, for example with PTFE or the like, in particular in a drum process.

One aspect of the invention relates to the use of the reciprocating-piston machine, in particular of the piston compressor, in a compressor or air compressor for a passenger motor vehicle chassis control system. A further aspect of the invention relates to the use of the reciprocating-piston machine, in particular of the piston compressor, for air treatment for a heavy goods vehicle. Furthermore, one aspect of the invention relates to the use of the reciprocating-piston machine in further compressors, for example an air-conditioning compressor in vehicles such as passenger motor vehicles and utility vehicles, in electrohydraulic servo steering systems, and furthermore in a compressor for ABS/EBS hydraulic pumps. One aspect of the invention also relates to the use of the invention in electric drives for vacuum pumps. The invention may also generally be used in piston connections.

Exemplary embodiments of the invention will now be described below on the basis of the drawings. The drawings are not necessarily intended to illustrate the exemplary embodiments to scale, with the drawings rather being of schematic and/or slightly distorted form where expedient for explanatory purposes. With regard to additions to the teaching that emerges directly from the drawings, reference is made to the relevant prior art. Here, it must be taken into consideration that numerous modifications and alterations may be made with regard to the form and the detail of an embodiment without departing from the general concept of the invention. The features of the invention disclosed in the description, in the drawings and in the claims may be essential for the refinement of the invention both individually and in any desired combination. Furthermore, the scope of the invention encompasses all combinations of at least two of the features disclosed in the description, in the drawings and/or in the claims. The general concept of the invention is not restricted to the exact form or the detail of the preferred embodiment shown and described below, or restricted to subject matter which would be restricted in relation to the subject matter claimed in the claims. Where dimension ranges are stated, it is also the intention that values lying within the stated limits are disclosed, and can be used and claimed as desired, as limit values. Further advantages, features and details of the invention will emerge from the following description of the preferred exemplary embodiments and on the basis of the drawings.

FIG. 1 shows, in the detail D, an air compressor with a reciprocating-piston machine in the form of a two-stage piston compressor 400 with a first compressor stage 401 and a second compressor stage 402, which is driven by means of a motor 500 as drive motor M.

Such a piston compressor 400 is preferably used for pneumatic compressed-air supply systems 1000 as shown in FIG. 1.

FIG. 1 shows an embodiment of a pneumatic circuit diagram of a pneumatic compressed-air supply system 1000 with a compressed-air supply installation 1001 with an air dryer arrangement 100, and of a pneumatic installation in the form of an air spring installation 1002. The compressed-air supply installation 1001 serves for the operation of the air spring installation 1002. The compressed-air supply installation 1001 has, for this purpose, a compressed-air feed 1 and a compressed-air connection 2 to the air spring installation 1002.

In the present case, the compressed-air feed 1 is formed with an air feed 0, with an air filter 0.1 positioned upstream of the air feed 0 and with an air compressor which is positioned downstream of the air feed 0 via the air feed line 270 and which is driven by means of the motor 500. The air compressor is formed here as an example of a reciprocating-piston machine in the form of a two-stage air compressor, specifically of a two-stage piston compressor 400 with a first compressor stage 401 and a second compressor stage 402 and with a connection (not designated in any more detail) of the compressed-air feed 1.

At the connection of the compressed-air feed 1, in the pneumatic main line 200, the connection of the drying container 101 of the air dryer arrangement 100 connects to the first part 201 of the pneumatic main line. The air dryer of the air dryer arrangement 100 is furthermore pneumatically connected by means of the second part 202 of the pneumatic main line for the purposes of conducting a compressed-air flow DL to a pneumatic installation, in the present case an air spring installation 1002.

In the main view shown in FIG. 1, it is provided that a branch line 230 branches off at the compressed-air feed 1 from the first part 201 of the pneumatic main line 200 and connects to a ventilation line 240 to the vent 3 to a ventilation filter 3.1 connected downstream of the vent; the vent is connected by means of the further branch connection 241 and a connection section 242 to the ventilation line 240 and also to a further ventilation line 260 via the branch connection 261.

The pneumatic main line 200 thus pneumatically connects the compressed-air feed 1 and the compressed-air connection 2, wherein the air dryer arrangement 100 and, further in the direction of the compressed-air connection 2, an unblockable check valve 311 and a first restrictor 331 are arranged in the pneumatic main line 200.

The pneumatically unblockable check valve 311 is, in the present case, a part of the directional valve arrangement 310 which, aside from the unblockable check valve 311, has a controllable ventilation valve 312 connected in series with a second restrictor 332 in the ventilation line 230. The pneumatically unblockable check valve 311 is in the present case arranged so as to likewise be connected in series with the first restrictor 331 in the pneumatic main line 200, wherein the pneumatic main line 200 is the only pneumatic line that continues as far as the air spring installation 1002 with a further pneumatic line 600. The series arrangement of first restrictor 331 and pneumatically unblockable check valve 311 is thus arranged in the pneumatic main line 200 between the air dryer arrangement 100 and the compressed-air connection 2 to the air spring installation 1002.

Furthermore, the compressed-air supply installation 1001 has a second pneumatic connection which is pneumatically connected to the pneumatic main line 200 and to the ventilation connection 3 and further filter 3.1 and/or silencer; specifically the abovementioned ventilation line 230. The nominal width of the second restrictor 332 is in the present case greater than the nominal width of the first restrictor 331.

The ventilation valve 312 arranged in the second pneumatic connection is formed in the present case as a 2/2 directional valve, which is separate from the pneumatically unblockable check valve 311, in the ventilation line 230.

The controllable ventilation valve 312 is thus, as an indirectly switched relay valve, part of a valve arrangement 300 with a control valve 320 in the form of a 3/2 directional solenoid valve. The control valve 320 can be electrically actuated by means of an electrical control signal transmissible in the form of a voltage and/or current signal via an electrical control line 321 to the coil 322 of the control valve 320. In the case of this electrical actuation, the control valve 320 can be transferred from the electrically deenergized position shown in FIG. 1, in which it shuts off the pneumatic control line 250, into a pneumatically opened position, in which pressure discharged from the pneumatic main line 200 via the pneumatic control line 250 is conducted onward for the pneumatic control of the controllable ventilation valve 312 as relay valve.

The controllable ventilation valve 312 is in the present case additionally equipped with a pressure-limiting means 313. The pressure-limiting means 313 picks off, via a pneumatic control line upstream of the ventilation valve 312—specifically between second restrictor 332 and ventilation valve 312—a pressure which, in the event of a threshold pressure being overshot, lifts a piston 314 of the ventilation valve 312 off the valve seat counter to the force of a spring 315, in the present case of an adjustable spring—that is to say moves the controllable ventilation valve 312 into the opened position even without actuation by means of the control valve 320. This prevents an excessively high pressure from prevailing in an undesired manner in the pneumatic system 1000, in particular in the air spring installation 1002.

In the presently closed state, the control valve 320 shuts off the control line 250 and is pneumatically connected via the further ventilation line 260 to the ventilation line 240 to the vent 3. In other words, a line section 251 of the control line 250 situated between ventilation valve 312 and control valve 320 is, in the closed position of the control valve 320 shown in FIG. 1, connected to the further ventilation line 260 between control valve 320 and vent 3. For this purpose, the further ventilation line 260 connects, at the further branch connection 261, to the ventilation line 230 and to the further ventilation line 240. These are thus merged in a section of a ventilation line 240 which is situated between the further branch connection 261 and the vent 3.

Thus, by means of the control valve 320, when a control pressure discharged from the pneumatic main line 200 or from the further pneumatic line 600 via the pneumatic control line 250 from the control connection 252 prevails, the ventilation valve 312 can be opened by exertion of pressure on the piston 314.

The piston 314 is in the present case designed as a double piston, such that it is particularly advantageously provided that the transfer of the control valve 320 into the opened state—in the above sense—leads not only to the opening of the ventilation valve 312 but also to the unblocking of the unblockable check valve 311. In other words, the control valve 320 of the solenoid valve arrangement 300 serves for actuating both the ventilation valve 312, which is provided separately from the check valve 311, and the check valve 311. This leads to the air dryer arrangement 100 being pneumatically opened on both sides when the control valve 320 is transferred into the opened position. This further operating setting that can be assumed by the compressed-air supply installation 1001 can be utilized during operation for the purposes of ventilating the air spring installation 1002 and simultaneously regenerating the air dryer arrangement 100.

The operating setting of the compressed-air supply installation 1001 shown in FIG. 1 serves, with passage of flow through the check valve 311 in a passage direction, in particular for the filling of the air spring installation 1002 via the pneumatic main line 200 and the further pneumatic line 600.

The air spring installation 1002 of FIG. 1 in the form of an air spring installation has in this case a number of four so-called bellows 1011, 1012, 1013, 1014 which are assigned to in each case one wheel of a vehicle which is not illustrated in any more detail, in the present case in the form of a passenger motor vehicle 2000, and which form in each case one air spring of the vehicle.

Furthermore, the air spring installation has an accumulator 1015 for storing rapidly available compressed air for the bellows 1011, 1012, 1013, 1014. Arranged upstream of said bellows 1011 to 1014, in each case in a spring branch line 601, 602, 603, 604 which proceeds from a gallery 610, is in each case one solenoid valve 1111, 1112, 1113, 1114, which serves in each case as a ride-height control valve for the opening or closing of an air spring formed with a bellows 1011 to 1014. The solenoid valves 1111 to 1114 in the spring branch lines 601 to 604 are designed as 2/2 directional valves in a valve block 1110. A solenoid valve 1115 in the form of a further 2/2 directional valve is, as an accumulator valve, positioned upstream of the accumulator 1015 in an accumulator branch line 605. The solenoid valves 1111 to 1115 are connected by means of the spring and accumulator branch lines 601 to 604 and 605 to a common collecting line, specifically the abovementioned gallery 610, and then to the further pneumatic line 600. The gallery 610 is thus pneumatically connected via the pneumatic line 600 to the compressed-air connection 2 of the compressed-air supply installation 1001. In the present case, the solenoid valves 1111 to 1115 are arranged in a valve block 1110. The solenoid valves are shown in FIG. 1 in an electrically deenergized state—here, the solenoid valves 1111 to 1115 are formed as solenoid valves which are closed when electrically deenergized. Other, modified embodiments may implement a different arrangement of the solenoid valves—it is also possible for fewer solenoid valves to be utilized within the valve block 1010.

For the filling of the air spring installation 1002, the solenoid valves 1111 to 1114 positioned upstream of the bellows 1011 to 1014 and/or the solenoid valve 1115 positioned upstream of the accumulator 1015 are moved into an opened position.

Nevertheless, owing to the check valve 311 presently not being unblocked, operation of the air spring installation 1002 in a manner decoupled from the compressed-air supply installation 1001 is possible. In other words, a cross-connection of bellows 1011 to 1014 (for example in off-road operation of a vehicle), filling of the bellows 1011 to 1014 from the accumulator 1015, or a pressure measurement in the air spring installation 1002 via the gallery 610, can be performed without pressure being applied to the compressed-air supply installation 1001.

In particular, owing to the check valve 311 being blocked from the compressed-air connection 2 to the compressed-air feed 1, and the closed control valve 320, the air dryer arrangement 100 is protected against unnecessary application of compressed air. It is thus advantageously the case that application of compressed air to the air dryer arrangement 100 is not advantageous in every operating setting of the air spring installation 1002. Rather, for an effective and rapid regeneration of the air dryer installation 100, it is advantageous if this is performed exclusively in the case of a ventilation of the air spring installation 1002 from the compressed-air connection 2 to the compressed-air feed 1, with an unblocked check valve 311.

For this purpose, as discussed above, the control valve 320 is moved into an opened switching position such that both the ventilation valve 312 opens and the check valve 311 is unblocked. A ventilation of the air spring installation 1002 can be performed via the first restrictor 331, the unblocked check valve 311, with regeneration of the air dryer arrangement 100, and subsequently via the second restrictor 332 and the opened ventilation valve 312 to the vent 3.

In other words, for the simultaneous unblocking actuation of the check valve 311 and opening actuation of the ventilation valve 312, a control piston 314 which is pneumatically actuatable by the control valve 320 is provided as a double relay piston, with a relay ventilation body 314.1 of the ventilation valve and a relay unblocking body 314.2 for the unblockable check valve 311. The double relay piston illustrates the present principle for the unblocking of the check valve 311 and simultaneous actuation of the ventilation valve 312 by means of the two coupled actuating elements—specifically by way of the relay unblocking body 314.2 and the relay ventilation body 314.1—which may be formed as a unipartite double relay body or, in a modification, also as separate bodies. Other, modified embodiments may implement a different arrangement of the valves, restrictors, lines and branching points. In a particularly preferred modification of a structural implementation, the abovementioned actuating elements of the double relay piston may be formed as unipartite regions of a double relay piston.

Figure 2:
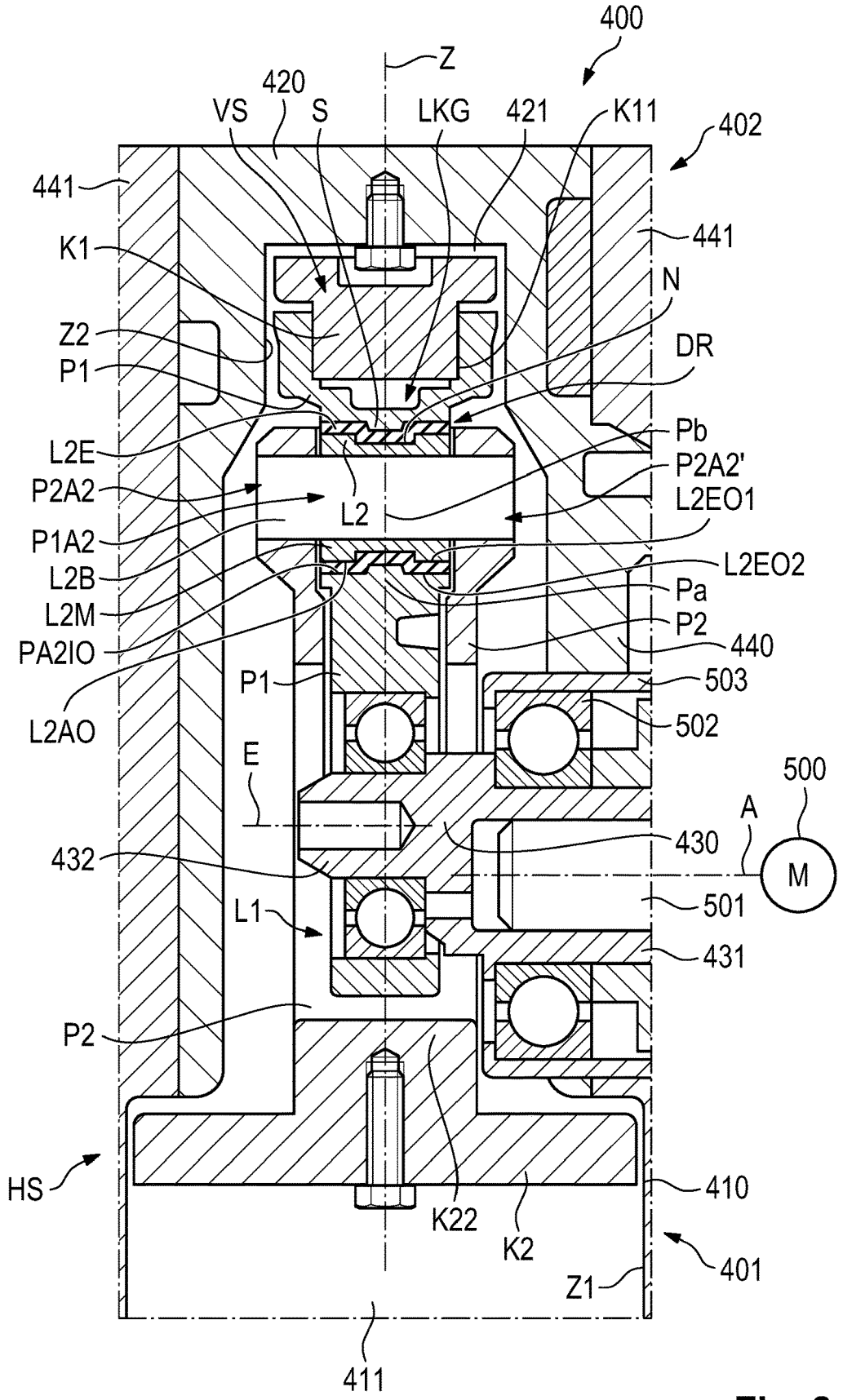
FIG. 2: shows, for an air compressor, a reciprocating-piston machine in the form of a two-stage piston compressor, with a first connecting rod for a first piston of a second (high-pressure) stage and with a second connecting rod of a first (low-pressure) stage, and the first connecting rod with a connecting-rod eye, with a coupling bearing element and with a damping element in the form of an elastomer element, which has been injection-molded into a damping annular chamber between a connecting-rod eye inner surface with a web and the coupling bearing element with a groove so as to fill the damping annular chamber such that a ball jointed configuration which generates a form fit is generated.
Figure 3:
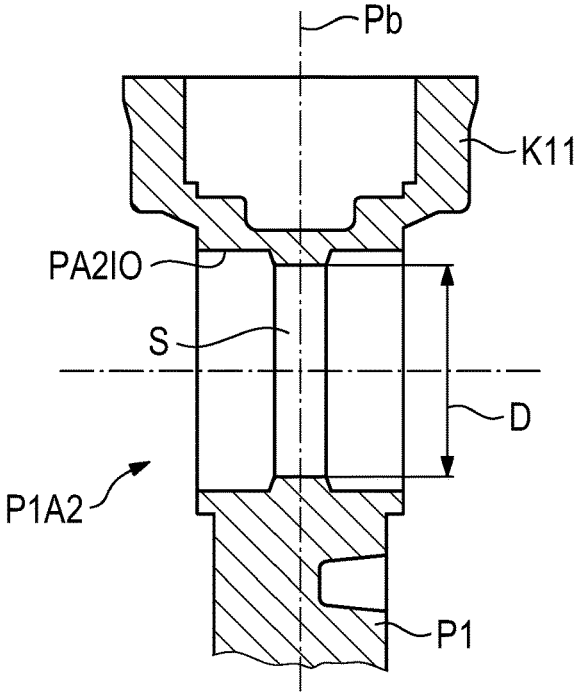
FIG. 3: shows a detail of the first connecting rod of the reciprocating-piston machine shown in FIG. 2 during the production process after the injection-molding of a web onto the connecting-rod eye inner surface.
Figure 4:
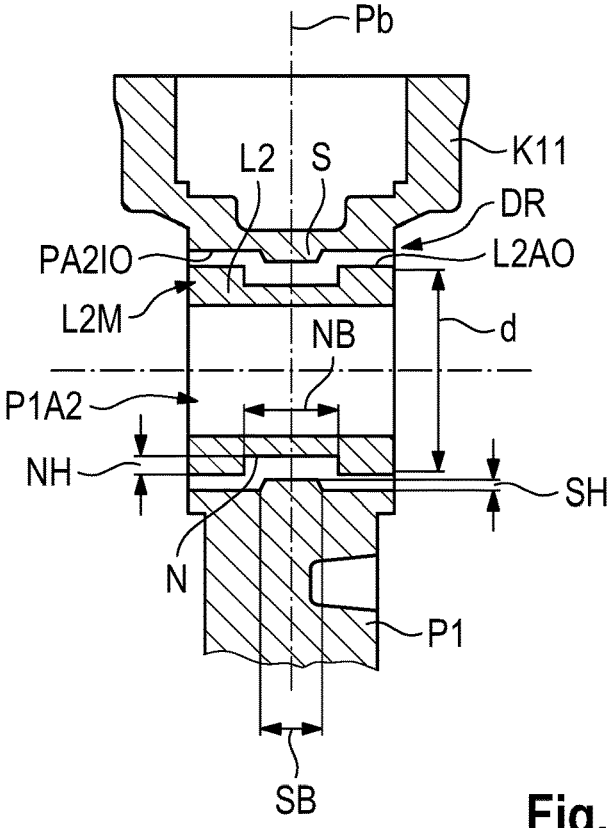
FIG. 4: shows a detail of the first connecting rod of the reciprocating-piston machine shown in FIG. 2 during the production process after the arrangement of a bearing bushing.
Figure 5:
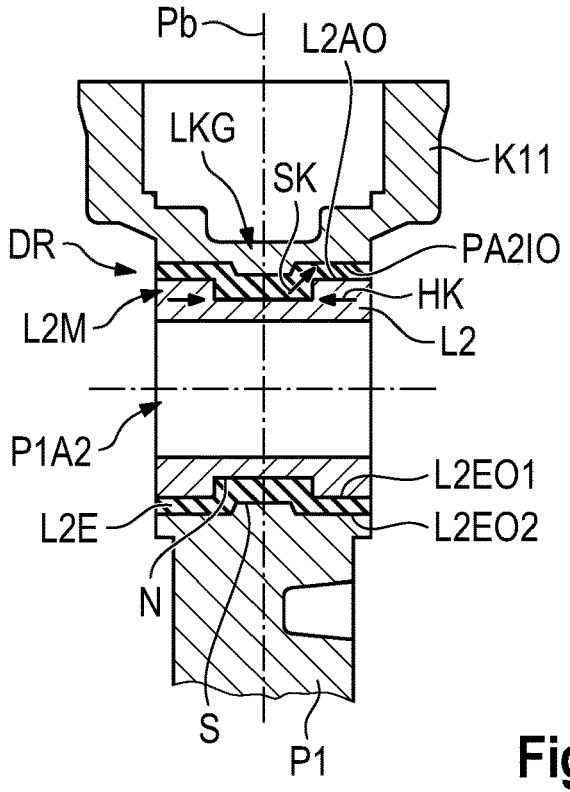
FIG. 5: shows a detail of the first connecting rod of the reciprocating-piston machine shown in FIG. 2 during the production process after the injection-molding and complete vulcanization of the damping element.

FIG. 2 now illustrates the details of the concept of the invention based on the example of a reciprocating-piston machine, specifically in the form of the two-stage piston compressor 400 of FIG. 1. FIG. 3 to FIG. 5 illustrate details regarding how the reciprocating-piston machine in the form of the two-stage piston compressor 400 of FIG. 1, in particular how a part of the first connecting rod P1 of the reciprocating-piston machine, is produced.

Referring firstly to FIG. 2, this shows a reciprocating-piston machine in the form of a double compressor as per the detail D of FIG. 1, specifically a twin compressor which is designed as a two-stage piston compressor 400 and which has a first compressor stage 401 and a second compressor stage 402 and with a motor 500 which, as drive motor M, is coupled by way of a drive shaft 501 to a crankshaft 430 of the piston compressor 400.

For this purpose, the crankshaft 430 has a drive shaft coupling 431, which serves as a receptacle for the drive shaft 501 of the drive motor M. The drive shaft coupling 431 is oriented along an axially oriented motor axis A. The crankshaft 430 is rotatably mounted, on the outside of the drive shaft coupling 431, in a bearing 502 which, in the present case, is designed as an annular ball bearing. The bearing 502 is in turn held on the motor housing 503 by means of a corresponding holding mechanism. In this way, the crankshaft 430 which can be driven by means of the drive motor M during operation is designed for driving the crankshaft 430 via the abovementioned drive shaft coupling 431 for the coupling of the drive shaft 501 of the drive motor 500.

The crankshaft 430 furthermore has a crankshaft journal 432 which is formed, eccentrically with respect to the motor axis A, on the crankshaft 430 and which extends along an eccentric axis referred to here as shaft axis E.

Driven in rotation by the crankshaft 430, the crankshaft journal 432 is thus designed to drive a first connecting rod P1 directly and a second connecting rod P2 indirectly. For this purpose, the crankshaft journal 432 is, by means of a crankshaft bearing element in the form of a first connecting-rod bearing L1, designed for the direct mounting of, and for directly driving, the first connecting rod P1. The second connecting rod P2 is in turn mounted movably on the first connecting rod P1 functioning as drive connecting rod P1, specifically as follower connecting rod P2, via a coupling bearing element in the form of a bearing bushing L2 and a damping element with elastically damping action in the form of an elastomer element L2E, which surround a coupling element in the form of a bearing journal L2B. That is to say, in this exemplary embodiment, the first connecting rod P1 is in the form of a drive connecting rod P1 and the second connecting rod P2 is in the form of a follower connecting rod P2.

The elastomer element L2E and the bearing bushing L2 are arranged in a connecting-rod eye P1A2 of the first connecting rod P1. The bearing bushing L2 is arranged parallel to the axially oriented motor axis A such that a bearing bushing outer surface L2AO of the bearing bushing L2 is situated opposite a connecting-rod eye inner surface PA2IO. Between the bearing bushing outer surface L2AO and the connecting-rod eye inner surface PA2IO of the connecting-rod eye P1A2, there is formed a damping annular chamber DR in which the elastomer element L2E has been injection-molded and completely vulcanized. The elastomer element L2E fills the damping annular chamber DR such that a ball-jointed configuration which generates a form fit is attained.

In this exemplary embodiment, the damping element surface L2EO1, which lies against the bearing bushing L2, and the damping element surface L2EO2, which lies against the connecting-rod eye inner surface PA2IO, are impressed by the bearing bushing L2 and by the connecting-rod eye inner surface PA2IO, such that a ball jointed configuration which generates a form fit is generated. A web S which runs centrally along the connecting-rod eye inner surface PA2IO and which extends in the direction of the bearing bushing outer surface L2AO presses the elastomer element L2E into a groove N which runs centrally along the bearing bushing outer surface L2AO and which extends away from the connecting-rod eye inner surface PA2IO, in order to generate the ball jointed configuration, which generates the form fit, in this exemplary embodiment. The elastomer element L2E, the connecting-rod eye inner surface PA2IO and the bearing bushing L2 are thus, in this exemplary embodiment, shaped so as to collectively form a ball-joint-like bearing LKG. Alternatively, the elastomer element L2E may also have an alternative shape which generates a ball jointed configuration which generates a form fit.

The elastomer element L2E fills the damping annular chamber DR such that holding forces generated as a result of the form fit are greater than shear forces which act on the elastomer element L2E during the operation of the reciprocating-piston machine 400. For this purpose, an outer diameter d of the bearing bushing L2 (see FIG. 4) is only slightly smaller than a smallest inner diameter D, generated by the web S, of the connecting-rod eye P1A2 (see FIG. 3). The outer diameter d of the bearing bushing L2 may for example be between 0.1% and 10% smaller than the smallest inner diameter D of the connecting-rod eye P1A2.

In this exemplary embodiment, the bearing bushing L2 is coated with a material L2M with a low coefficient of friction, in the present case in the form of PTFE. In other exemplary embodiments, the coupling bearing element may also be coated with a different material with a low coefficient of friction. In this exemplary embodiment, the elastomer element L2E is not vulcanized onto the connecting-rod eye inner surface PA2IO and is also not vulcanized onto the bearing bushing outer surface L2AO.

The first connecting-rod bearing L1 is designed as an annular ball bearing. In other exemplary embodiments, the first connecting-rod bearing may also be some other bearing, for example a rolling bearing, needle-roller bearing, plain bearing or the like. The elastomer element L2E has damping characteristics such that the elastomer element L2E allows a noise reduction and a reduction in material wear of the bearing bushing L2. The bearing journal L2B is fixedly connected to the second connecting rod P2. For this purpose, the bearing journal L2B is, at its longitudinal ends, pressed together with the connecting rod P2 with an interference fit in connecting-rod eyes P2A2 and P2A2' of the second connecting rod P2. The first connecting rod P1 and the second connecting rod P2 are thus movable relative to one another about the bearing journal L2B.

The first piston K1 is, as a separate part, inserted into the head end of the first connecting rod P1, and held there, by means of a piston holder K11. The second piston K2 is formed integrally and in unipartite fashion on the head end K22 of the second connecting rod P2—that is to say distally opposite the first piston K1 along a cylinder axis Z. For this purpose, the second connecting rod P2 is, as a unipartite, approximately annular component, as can be seen in FIG. 2, mounted on the bearing bushing L2 so as to be rotationally movable relative to the connecting rod P1. Alternatively, it is also possible for the first piston to be formed integrally on the first connecting rod P1 or for the second piston to be held on the second connecting rod P2.

In the construction shown in FIG. 2, under the action of rotational drive of the crankshaft 430, an eccentric rotational movement of the crankshaft journal 432 can be attained during the operation of the compressor 400, such that the first and second pistons K1, K2 are each moved with a reciprocating movement for the purposes of compressing compressed air in the corresponding second and first compressor stages 402, 401.

The second piston K2 of the first compressor stage 401 moves, for this purpose, in a cylinder swept volume 411 of the first cylinder 410 in the first (low-pressure) compressor stage 401. The first piston K1 moves, for this purpose, in a cylinder swept volume 421 of a second cylinder 420 of the second (high-pressure) compressor stage 402. The first and second cylinders 410, 420 are part of a housing 440 of the overall air compressor with piston compressor 400, drive motor M and crankshaft 430. The housing 440 of the air compressor is held by means of further components 441 on the housing of a compressed-air supply installation 1001 as shown in FIG. 1.

FIG. 2 shows the twin compressor 400, in the present case in an operating setting in which the second piston K2 of the (low-pressure) compressor stage 401 is in a stroke position HS, that is to say the compression of the air situated in the swept volume 411 is impending. By contrast, the first piston K1 of the second compressor stage 402 is situated in a compression position VS, that is to say compressed air can be discharged in compressed form from the second high-pressure stage 402 to the compressed-air supply installation 1001.

The movement of the first and second pistons K1, K2 during the operation of the piston compressor 400 takes place basically along the cylinder axis Z. This lies center-symmetrically with respect to cylinder barrels Z1 and Z2 of the first and second cylinder swept volumes 411, 421 respectively for the second and first pistons K2, K1 respectively of the first and second cylinders 410, 420 respectively. In this exemplary embodiment, the first connecting rod P1 runs along a first connecting-rod axis Pb, which runs parallel to the radially oriented cylinder axis Z, and the second connecting rod P2 runs along a second connecting-rod axis Pa, which runs parallel to the radially oriented cylinder axis Z. The connecting-rod length of the first connecting rod P1 may for example be of the order of around 52.00 mm.

The first connecting rod P1 may for example also have a connecting-rod length between 50 and 70 mm, in particular a connecting-rod length of 66 mm. The second connecting rod may for example have a connecting-rod length between 40 and 60 mm, in particular a connecting-rod length of 53 mm. In the case of a connecting-rod length of the second connecting rod of 53 mm, the spacing between a piston head of the piston K2 and the eccentric crankshaft journal 432 may for example be between 15 and 25 mm, in particular 21 mm. The above-stated dimensions may allow a deflection angle of the connecting rods with respect to one another of up to 20°, for example 14°, and +/−7° and in particular 7°. In this exemplary embodiment, the connecting rods P1 and P2 are designed such that a maximum deflection angle of the deflection of the connecting rods P1 and P2 between the first connecting-rod axis Pb and the second connecting-rod axis Pa in the direction of a deflection axis running perpendicular to the cylinder axis Z and perpendicular to the motor axis A amounts to at most 14°.

In this exemplary embodiment, the bearing journal L2B has a diameter of 8 mm and may for example have a diameter between 5 mm and 12 mm. The diameter of the bearing journal L2B is constant in this exemplary embodiment. The diameter of the bearing journal L2B may also vary along its longitudinal axis.

The cylinder axis Z is oriented so as to run along a radius around the shaft axis E (eccentric axis E). The shaft axis E runs exactly perpendicular to the cylinder axis Z. This means that the eccentric crankshaft journal 432 of the crankshaft 430 is likewise arranged exactly perpendicular to the cylinder axis Z in the piston compressor 400. Sufficiently reliable and sealed running of the second and first pistons K2, K1 in the first (low-pressure) compressor stage and (high-pressure) compressor stage 401, 402 respectively is thus ensured owing to the running direction of the pistons K2, K1 likewise along the cylinder axis Z.

For this purpose, the arrangement of the first connecting rod P1 with piston K1 and of the second connecting rod P2 with piston K2, with the mounting thereof by means of the first connecting-rod bearing L1 and the bearing bushing L2 respectively, is implemented exactly along the cylinder axis Z. The bearing bushing L2 may, for this purpose, be oriented parallel to the motor axis A and installed into the connecting-rod eye P1A2.

As a result, a reciprocating-piston machine in the form of a twin compressor 400 with first and second compressor stages 401, 402 is provided, in the case of which the first connecting rod P1 of the second, specifically (high-pressure) compressor stage 402 is formed, wherein the first connecting rod P1 is mounted by means of the connecting-rod bearing L1 directly on the crankshaft journal 432—that is to say as drive connecting rod P1—and the second connecting rod P2 of the first, in this case (low-pressure) compressor stage 401 is formed, wherein the second connecting rod P2 is mounted by means of the bearing bushing L2 indirectly on the crankshaft journal 432, that is to say directly on the first connecting rod P1—that is to say as follower connecting rod P2 on the drive connecting rod P1.

The above-described embodiments with drive connecting rod and follower connecting rod have duly proven particularly advantageous for a twin compressor. The concept of the invention is however not restricted to this.

FIG. 3 shows a detail of the first connecting rod P1 of the reciprocating-piston machine shown in FIG. 2 during the production process. In the production step shown in FIG. 3, the web S has been injection-molded on centrally along the connecting-rod eye inner surface PA2IO, which web extends in the direction of the bearing bushing L2. A smallest inner diameter D of the connecting-rod eye P1A2 is generated by the web S.

In the production step shown in FIG. 4, the bearing bushing L2 is arranged in the connecting-rod eye P1A2, parallel to the axially oriented motor axis A, such that the bearing bushing outer surface L2AO of the bearing bushing L2 is situated opposite the connecting-rod eye inner surface PA2IO. The bearing bushing L2 has, in this exemplary embodiment, a groove N which has a greater width NB and a greater height NH than the web S, that is to say the groove N has a width NB greater than the width SB of the web S and has a height NH greater than the height SH of the web S. Furthermore, the bearing bushing L2 has been selected such that the bearing bushing L2 has an outer diameter d smaller than the smallest inner diameter D, generated by the web S, of the connecting-rod eye P1A2. The damping annular chamber DR is formed between the bearing bushing L2 and the connecting-rod eye inner surface PA2IO.

In the production step shown in FIG. 5, the elastomer element L2E has been injection-molded into the damping annular chamber DR and completely vulcanized, without the elastomer element L2E being vulcanized onto the surfaces that lie against the elastomer element L2E, that is to say the connecting-rod eye inner surface PA2IO and the bearing bushing outer surface L2AO. The elastomer element surfaces L2EO1 and L2EO2 have thus not been vulcanized onto the surfaces that lie against them. The connection is based on the fact that a quasi-form fit is generated. The diameters d and D are approximately equal, such that, in order to release the connection, high shear forces must be imparted within the elastomer element L2E. The diameters d and D may be coordinated such that a release as a result of the operation of the reciprocating-piston machine 400 is ruled out, because the holding forces HK are in this case greater than the shear forces SK that arise during operation.

Figure 6:
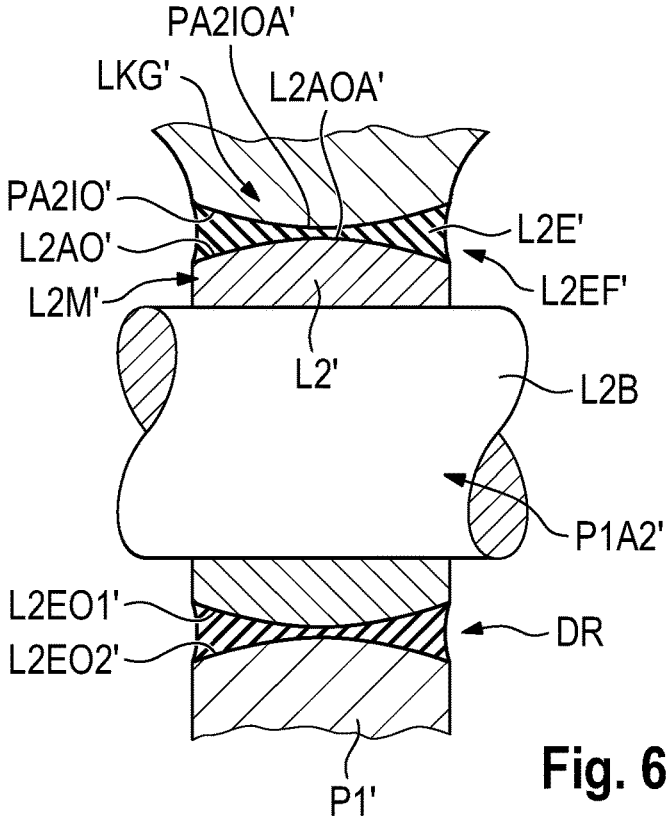
FIG. 6: shows a detail of a first connecting rod of a second exemplary embodiment of a reciprocating-piston machine with a first connecting rod, the connecting-rod eye of which has an outwardly domed, arcuate connecting-rod eye inner surface and in which a coupling bearing element with a bearing bushing with an outwardly domed, arcuate bearing bushing outer surface and a damping element in the form of a biconcavely shaped elastomer element are arranged; in other words, the connecting-rod eye inner surface and the bearing bushing outer surface are convexly curved in the direction of one another.

FIG. 6 shows a detail of a first connecting rod P1' of a second exemplary embodiment of a reciprocating-piston machine. The second exemplary embodiment also comprises the first connecting rod P1' in the form of a drive connecting rod P1' and a second connecting rod in the form of a follower connecting rod. In a connecting-rod eye P1A2' of the first connecting rod P1', there are arranged a coupling bearing element in the form of a bearing bushing L2' and a damping element in the form of an elastomer element L2E'.

A connecting-rod eye inner surface PA2IO' of the connecting-rod eye P1A2' and a bearing bushing outer surface L2AO' of the bearing bushing L2' are in each case domed outwardly toward one another. In this exemplary embodiment, the bearing bushing outer surface L2AO' has an arcuate, encircling bearing bushing outer surface section L2AOA' which is domed in the direction of the oppositely situated connecting-rod eye inner surface PA2IO'. The connecting-rod eye inner surface PA2IO' correspondingly has an arcuate, encircling connecting-rod eye inner surface section PA2IOA' which is domed in the direction of the oppositely situated bearing bushing outer surface L2AO'. In other words, the connecting-rod eye inner surface and the bearing bushing outer surface are convexly curved in the direction of one another.

In other exemplary embodiments, the surfaces may also have some other domed formation or multiple domed formations. The connecting-rod eye inner surface and the bearing bushing outer surface may also, in other exemplary embodiments, be shaped so as to each have at least one arcuate surface section which is domed in the direction of the opposite surface and which encircles the respective one of the opposite surfaces.

Between the connecting-rod eye inner surface PA2IO' and the bearing bushing outer surface L2AO', there is formed a damping annular chamber DR into which the elastomer element L2E' has been injection-molded and completely vulcanized. In this exemplary embodiment, too, the elastomer element L2E' has not been vulcanized onto the surfaces that lie against it.

The damping element surfaces L2EO1' and L2EO2', which lie against the bearing bushing L2', in particular against the bearing bushing outer surface L2AO' thereof, and the connecting-rod eye inner surface PA2IO', of the elastomer element L2E' are impressed by the connecting-rod eye inner surface PA2IO' and the bearing bushing outer surface L2AO' such that the elastomer element L2E' has a biconcave shape L2EF' along the damping annular chamber DR. The elastomer element L2E', the connecting-rod eye inner surface PA2IO' and the bearing bushing L2' are thus shaped so as to collectively form a ball-joint-like bearing LKG'. By means of an optimization of the shaping, the rolling characteristics, and thus also the acoustics characteristics of the reciprocating-piston machine into which the first connecting rod P1' is installed, can be further improved. In other exemplary embodiments, the damping element may be arranged with a shape, which is biconcave parallel to the axially oriented motor axis and which nestles against the connecting-rod eye inner surface and the bearing bushing outer surface, along the damping annular chamber between the connecting-rod eye inner surface and the bearing bushing outer surface.

In this exemplary embodiment, the bearing bushing L2' is completely coated with a material L2M' with a low coefficient of friction, in the present case in the form of PTFE. For this purpose, the bearing bushing L2' has been coated in a drum process.

Figure 7:
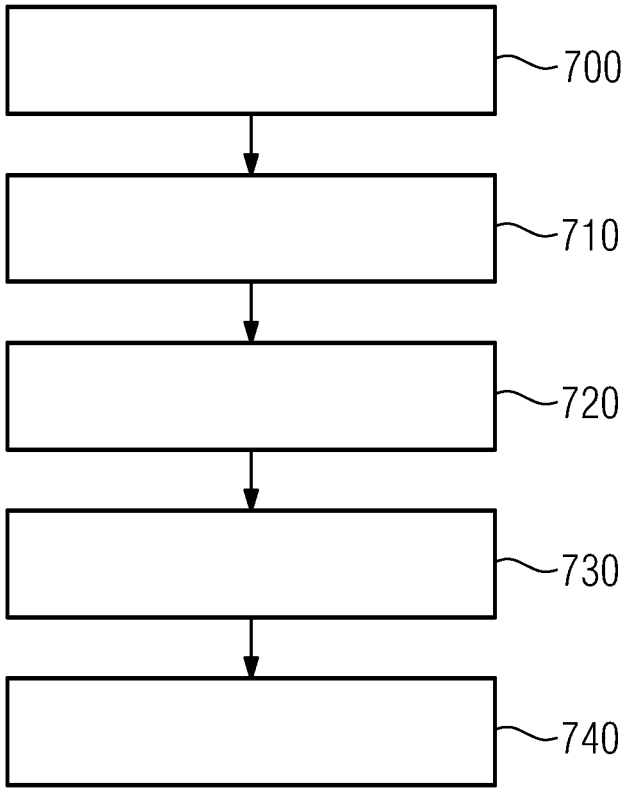
FIG. 7: shows an exemplary embodiment of a method for producing a reciprocating-piston machine.

FIG. 7 shows an exemplary embodiment of a method for producing a reciprocating-piston machine as illustrated for example in FIG. 2. The reciprocating-piston machine produced by means of the method has at least one first connecting rod, which is designed for the deflection of a first piston and which is in the form of a drive connecting rod with a connecting-rod eye, a second connecting rod, which is designed for the deflection of a second piston and which is in the form of a follower connecting rod with at least one further connecting-rod eye, and a coupling element, which in the assembled state extends through the connecting-rod eye and the at least one further connecting-rod eye and which is in the form of a bearing journal. The drive connecting rod and the follower connecting rod are rotationally movable relative to one another about the bearing journal.

In step 700, a web is injection-molded on centrally along a connecting-rod eye inner surface of the connecting-rod eye of the drive connecting rod, which web, in an assembled state, extends in the direction of the bearing journal.

In step 710, a coupling bearing element in the form of a bearing bushing is provided with a groove running centrally along a bearing bushing outer surface. In an assembled state, the groove extends away from the connecting-rod eye inner surface. In this exemplary embodiment of the production method, the groove has a greater width and a greater height than the web.

In step 720, the bearing bushing is arranged in the connecting-rod eye of the drive connecting rod such that, during operation, said bearing bushing is arranged parallel to an axially oriented motor axis and the bearing bushing outer surface of the bearing bushing is situated opposite the connecting-rod eye inner surface. In this exemplary embodiment, the bearing bushing is selected so as to have an outer diameter smaller than a smallest inner diameter, generated by the web, of the connecting-rod eye. The bearing bushing may be arranged so as to set a piston length and thus also a dead space.

In step 730, a damping element in the form of an elastomer element is injection-molded into a damping annular chamber that is formed between the connecting-rod eye inner surface and the bearing bushing outer surface, and the damping annular chamber is filled with the elastomer element such that, after complete vulcanization, a ball-jointed configuration which generates a form fit is generated between the bearing bushing and the connecting-rod eye inner surface.

In step 740, the elastomer element is completely vulcanized under the action of pressure and heat without being vulcanized onto the connecting-rod eye inner surface and the bearing bushing outer surface. That damping element surface of the elastomer element which lies against the connecting-rod eye inner surface is in this case impressed into the groove of the bearing bushing outer surface by the web, such that a ball jointed configuration which generates a form fit arises.

Steps 700 and 710 may also be substituted by alternative steps which adapt the shape of the connecting-rod eye inner surface and bearing bushing outer surface such that these, together with an elastomer element which is injection-molded into the damping annular chamber formed between said connecting-rod eye inner surface and bearing bushing outer surface and which is completely vulcanized, generate a ball jointed configuration which generates a form fit.

In an alternative exemplary embodiment, step 700 may for example be substituted by a step in which the connecting-rod eye inner surface is domed in the direction of the bearing bushing outer surface and step 710 may be substituted by a step in which the bearing bushing outer surface is domed in the direction of the connecting-rod eye inner surface, such that, when the bearing bushing has been arranged in the connecting-rod eye in step 720, said bearing bushing outer surface and connecting-rod eye inner surface are domed toward one another. The damping annular chamber formed between the connecting-rod eye inner surface and the bearing bushing outer surface can then assume a shape which is biconcave parallel to the axially oriented motor axis, such that the elastomer element injection-molded into the damping annular chamber and completely vulcanized in steps 730 and 740 can also have a shape which is biconcave parallel to the axially oriented motor axis and which nestles against the connecting-rod eye inner surface and the bearing bushing outer surface. The elastomer element then in this case fills the damping annular chamber such that a ball jointed configuration which generates a form fit arises between the bearing bushing and the connecting-rod eye inner surface. The elastomer element serves, together with the bearing bushing outer surface and the connecting-rod eye inner surface, for ball-joint-like mounting and can optimize the rolling characteristics in a manner dependent on the shaping. This can reduce wear and improve the acoustics characteristics.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE DESIGNATIONS

0 Air feed, intake arrangement
0.1 Filter element, air filter
1 Compressed-air feed
2 Compressed-air connection
3 Ventilation connection
3.1 Ventilation filter, filter element, silencer
100 Air dryer arrangement
101 Drying container
200 Pneumatic main line
201 First part of the pneumatic main line
202 Second part of the pneumatic main line
230 Branch line, ventilation line
240 Further ventilation line
241 Further branch connection
242 Connection section
250 Pneumatic control line
251 Line section
252 Control connection
260 Further ventilation line
261 Branch connection
270 Air feed line
300 Valve arrangement, solenoid valve arrangement

310 Directional valve arrangement
311 Check valve
312 Ventilation valve
313 Pressure-limiting means
314 Piston
314.1 Relay ventilation body
314.2 Relay unblocking body
315 Adjustable spring
320 Control valve
321 Electrical control line
322 Coil
331 First restrictor
332 Second restrictor
400 Reciprocating-piston machine in the form of an air compressor, in particular in the form of a two-stage piston compressor
401 First (low-pressure) compressor stage
402 Second (high-pressure) compressor stage
410 First cylinder
411, 421 Cylinder swept volume
420 Second cylinder
430 Crankshaft
431 Drive shaft coupling
432 Crankshaft journal
440 Housing
441 Further housing components
500 Motor
501 Drive shaft
M Drive motor
502 Bearing
503 Motor housing
600 Further pneumatic line
601, 602, 603, 604 Spring branch line
605 Accumulator branch line
610 Gallery
1000 Compressed-air supply system
1001 Compressed-air supply installation
1002 Pneumatic installation in the form of an air spring installation
1011, 1012, 1013, 1014 Bellows
1110 Valve block
1015 Accumulator
1111 to 1115 Directional solenoid valve
2000 Vehicle in the form of a passenger motor vehicle
A Motor axis
D Detail
DL Compressed-air flow
DR Damping annular chamber
E Eccentric axis, shaft axis
HK Holding force
HS Stroke position
K1 First piston
K2 Second piston
K11 Piston holder
K22 Head end
L1 First connecting-rod bearing
L2, L2' Bearing bushing
L2AO, L2AO' Bearing bushing outer surface
L2AOA' Encircling bearing bushing outer surface section
L2B Bearing journal
L2E, L2E' Damping element in the form of an elastomer element
L2EF' Biconcave shape of the elastomer element
L2EO1, L2EO2, L2EO1', L2EO2' Elastomer element surfaces
LKG, LKG' Ball-joint-like bearing
L2M, L2M' Material with low friction coefficient in the form of PTFE
N Groove
NB Groove width
NH Groove height
P1, P1' First connecting rod in the form of a drive connecting rod
P2 Second connecting rod in the form of a follower connecting rod
Pa Connecting-rod axis of the second connecting rod
Pb Connecting-rod axis of the first connecting rod
P1A2, P1A2' Connecting-rod eye of the first connecting rod
P2A2, P2A2' Connecting-rod eyes of the second connecting rod
PA2IO, PA2IO' Connecting-rod eye inner surface
PA2IOA' Encircling connecting-rod eye inner surface section
S Web
SB Web width
SH Web height
SK Shear force
VS Compression position
Z Cylinder axis
Z1 First cylinder barrel
Z2 Second cylinder barrel

The invention claimed is:

1. A reciprocating-piston machine, comprising:

a first connecting rod configured to deflect a first piston and which has a connecting-rod eye, the first connecting rod comprising a drive connecting rod;

a second connecting rod configured to deflect a second piston and which has at least one further connecting-rod eye, the second connecting rod comprising a follower connecting rod;

a coupling element which extends through the connecting-rod eye and the at least one further connecting-rod eye and about which the first connecting rod and the second connecting rod are rotationally movable relative to one another;

a coupling bearing element arranged between the coupling element and a connecting-rod eye inner surface of the connecting-rod eye; and a damping element with elastic damping action arranged in a damping annular chamber between the coupling bearing element and the connecting-rod eye inner surface of the connecting-rod eye, wherein the damping element fills the damping annular chamber such that a ball joint which generates a form fit is formed between the coupling bearing element and the connecting-rod eye inner surface of the connecting-rod eye.

2. The reciprocating-piston machine of claim 1, wherein the ball joint, which generates the form fit, between the coupling bearing element and the connecting-rod eye inner surface is generated by at least one of the damping element surfaces, which lie against the coupling bearing element and the connecting-rod eye inner surface, of the damping element being impressed by the coupling bearing element and/or the connecting-rod eye inner surface.

3. The reciprocating-piston machine of claim 1, wherein the damping element fills the damping annular chamber such that holding forces generated as a result of the form fit are greater than shear forces which act on the damping element during operation of the reciprocating-piston machine.

4. The reciprocating-piston machine of claim 1, wherein the coupling bearing element has a bearing bushing which has a bearing bushing outer surface situated opposite the connecting-rod eye inner surface.

5. The reciprocating-piston machine of claim 4, wherein the connecting-rod eye inner surface and the bearing bushing outer surface each have at least one arcuate surface section which is domed in a direction of the opposite surface and which encircles a respective one of the opposite surfaces, the connecting-rod eye inner surface and the bearing bushing outer surface being convexly curved in a direction of one another, and wherein the damping element surfaces, which lie against the coupling bearing element and the connecting-rod eye inner surface, of the damping element are impressed by the connecting-rod eye inner surface and the bearing bushing outer surface such that the damping element has a biconcave shape along the damping annular chamber.

6. The reciprocating-piston machine of claim 4, wherein the connecting-rod eye has a web which runs centrally along the connecting-rod eye inner surface and which extends in a direction of the bearing bushing outer surface.

7. The reciprocating-piston machine of claim 6, wherein the bearing bushing has an outer diameter smaller than a smallest inner diameter, generated by the web, of the connecting-rod eye.

8. The reciprocating-piston machine of claim 7, wherein the outer diameter of the bearing bushing is between 0.1% and 10% smaller than the smallest inner diameter of the connecting-rod eye.

9. The reciprocating-piston machine of claim 6, wherein the bearing bushing has a groove which runs centrally along the bearing bushing outer surface and which extends away from the connecting-rod eye inner surface and which has a greater width and a greater height than the web.

10. The reciprocating-piston machine of claim 4, wherein the bearing bushing is coated with a material with a low coefficient of friction.

11. The reciprocating-piston machine of claim 1, wherein the damping element is injection-molded into the damping annular chamber and is completely vulcanized.

12. The reciprocating-piston machine of claim 11, wherein the coupling bearing element has a bearing bushing which has a bearing bushing outer surface situated opposite the connecting-rod eye inner surface, and wherein the damping element is not vulcanized onto the connecting-rod eye inner surface and/or is not vulcanized onto the bearing bushing outer surface.

13. The reciprocating-piston machine of claim 1, wherein the damping element, the connecting-rod eye inner surface, and the coupling bearing element are shaped so as to collectively form a ball-joint-like bearing.

14. The reciprocating-piston machine of claim 1, wherein the connecting-rod eye of the first connecting rod is arranged between two of the further connecting-rod eyes of the second connecting rod and the coupling element extends through the three connecting-rod eyes.

15. The reciprocating-piston machine of claim 1, wherein the reciprocating-piston machine has a first cylinder and a second cylinder, the first piston being assigned to the first cylinder and the second piston being assigned to the second cylinder, and, during operation, the first and second pistons are deflected along a radially oriented cylinder axis in a respective cylinder swept volume of the respective cylinder, wherein the reciprocating-piston machine has a crankshaft which is drivable during operation and which has a crankshaft journal which is arranged along a shaft axis of the crankshaft, which shaft axis runs eccentrically with respect to an axially oriented motor axis and runs perpendicular to the radially oriented cylinder axis, wherein the reciprocating-piston machine has a drive shaft coupling which is oriented along the axially oriented motor axis and which is configured to couple a drive shaft for driving the crankshaft, wherein the first connecting rod runs along a first connecting-rod axis running parallel to the radially oriented cylinder axis, and wherein the second connecting rod runs along a second connecting-rod axis running parallel to the radially oriented cylinder axis.

16. The reciprocating-piston machine of claim 15, wherein the first connecting rod is mounted by a crankshaft bearing element directly on the crankshaft journal and is movable by the crankshaft journal, and the second connecting rod is movable by the coupling element.

17. The reciprocating-piston machine of claim 15, wherein the connecting rods are configured such that a maximum deflection angle of a deflection of the connecting rods between the first connecting-rod axis and the second connecting-rod axis in a direction of a deflection axis running perpendicular to the cylinder axis and perpendicular to the motor axis amounts to at most 14°.

18. The reciprocating-piston machine of claim 15, wherein the first piston is held on the first connecting rod by a piston holder, wherein the second connecting rod is connected to the first connecting rod by the coupling bearing element and the coupling element, and wherein the second piston is formed integrally on the second connecting rod.

19. The reciprocating-piston machine of claim 15, wherein the reciprocating-piston machine comprises the two-stage compressor with a first and a second compressor stage, comprising a twin compressor, wherein the first connecting rod of the second compressor stage, which second compressor stage comprises a high-pressure compressor stage, is formed, and/or the second connecting rod of the first compressor stage, which first compressor stage comprises a low-pressure compressor stage, is formed, and wherein the second connecting rod is mounted by the coupling bearing element and the coupling element directly on the first connecting rod.

20. A compressed-air supply installation for operation of a pneumatic installation of an air spring installation of a vehicle with a compressed-air flow, comprising:

an air dryer arrangement in a pneumatic main line;

a valve arrangement, which is pneumatically connected to the pneumatic main line and which is configured to control the compressed-air flow;

an air dryer in the pneumatic main line; and an air compressor having the reciprocating-piston machine of claim 1, wherein the pneumatic main line pneumatically connects a compressed air feed from the air compressor and a compressed air connection to the pneumatic installation, and wherein the reciprocating-piston machine is connected to the compressed-air feed.

21. A compressed-air supply system, comprising:

a pneumatic installation; and the compressed-air supply installation of claim 20 for operation of the pneumatic installation with a compressed-air flow, comprising an air spring installation of a vehicle, wherein the pneumatic main line pneumatically connects a compressed-air feed from the air compressor and a compressed-air connection to the pneumatic installation.

22. A vehicle, comprising:

a pneumatic installation comprising an air spring installation; and the compressed-air supply installation of claim 20 for operation of the pneumatic installation with a compressed-air flow.

23. A method for producing a reciprocating-piston machine, comprising:

providing a first connecting rod configured for deflecting a first piston and which has a connecting-rod eye, the first connecting rod comprising a drive connecting rod;

providing a second connecting rod configured for deflecting a second piston and which has at least one further connecting-rod eye, the second connecting rod comprising a follower connecting rod;

providing a coupling element which, in an assembled state, extends through the connecting-rod eye and the at least one further connecting-rod eye and about which the first connecting rod and the second connecting rod are rotationally movable relative to one another;

arranging a coupling bearing element between the coupling element and a connecting-rod eye inner surface of the connecting-rod eye;

arranging a damping element with elastic damping action in a damping annular chamber between the coupling bearing element and the connecting-rod eye inner surface of the connecting-rod eye; and filling the damping annular chamber with the damping element such that a ball joint which generates a form fit is formed between the coupling bearing element and the connecting-rod eye inner surface of the connecting-rod eye.

24. The method of claim 23, wherein the damping annular chamber is filled with the damping element such that at least one of the damping element surfaces, which lie against the coupling bearing element and the connecting-rod eye inner surface, of the damping element is impressed by the coupling bearing element and/or the connecting-rod eye inner surface.

25. The method of claim 23, wherein a web which extends in a direction of the coupling element is injection-molded on centrally along the connecting-rod eye inner surface.

26. The method of claim 25, wherein a bearing bushing is provided as part of the coupling bearing element, and the bearing bushing is arranged in the connecting-rod eye, parallel to an axially oriented motor axis, such that a bearing bushing outer surface of the bearing bushing is situated opposite the connecting-rod eye inner surface.

27. The method of claim 26, wherein the bearing bushing has an outer diameter smaller than a smallest inner diameter, generated by the web, of the connecting-rod eye.

28. The method of claim 26, wherein the bearing bushing, before being arranged in the connecting-rod eye, is provided with a groove which runs centrally along the bearing bushing outer surface and which extends away from the connecting-rod eye inner surface and which has a greater width and a greater height than the web.

29. The method of claim 23, wherein the coupling bearing element has a bearing bushing which is arranged in the connecting-rod eye, parallel to an axially oriented motor axis, such that a bearing bushing outer surface of the bearing bushing is situated opposite the connecting-rod eye inner surface, and wherein the connecting-rod eye inner surface and the bearing bushing outer surface are shaped so as to each have at least one arcuate surface section which is domed in a direction of the opposite surface and which encircles a respective one of the opposite surfaces, the connecting-rod eye inner surface and the bearing bushing outer surface being convexly curved in a direction of one another.

30. The method of claim 29, wherein the damping element is arranged with a shape, which is biconcave parallel to the axially oriented motor axis and which nestles against the connecting-rod eye inner surface and the bearing bushing outer surface, along the damping annular chamber between the connecting-rod eye inner surface and the bearing bushing outer surface.

31. The method of claim 23, wherein the damping element is injection-molded into the damping annular chamber and is completely vulcanized.

32. The method of claim 31, wherein, during the complete vulcanization, the damping element is not vulcanized onto the connecting-rod eye inner surface and/or is not vulcanized onto the coupling bearing element.

* * * * *